US005766377A

United States Patent [19]

Mueller et al.

[11] Patent Number: 5,766,377

[45] Date of Patent: Jun. 16, 1998

[54] COPPER-ZINC-ALLOY FOR USE IN DRINKING-WATER INSTALLATIONS

[75] Inventors: Gert Mueller, Neu-Ulm; Harald Siegele, Voehringen; Michael Bohsmann, Ulm, all of Germany

[73] Assignee: Wieland-Werke AG, Ulm, Germany

[21] Appl. No.: 714,498

[22] Filed: Sep. 16, 1996

Related U.S. Application Data

[62] Division of Ser. No. 547,453, Oct. 24, 1995, abandoned.

[30] Foreign Application Priority Data

Oct. 28, 1994 [DE] Germany ..... 44 38 485.8

[51] Int. Cl.[6] ..... C22C 9/04

[52] U.S. Cl. ..... 148/434; 420/477; 420/479; 420/483; 420/484

[58] Field of Search ..... 420/477, 478, 420/479, 483, 484; 148/434; 239/16, 24

[56] References Cited

U.S. PATENT DOCUMENTS

| | | | |
|---|---|---|---|
| 1,959,509 | 5/1934 | Tour | 75/1 |
| 5,137,685 | 8/1992 | McDevitt et al. | 420/477 |
| 5,167,726 | 12/1992 | LoIacono et al. | 148/432 |
| 5,258,108 | 11/1993 | Cassidy | 204/150 |
| 5,487,867 | 1/1996 | Singh | 420/471 |

FOREIGN PATENT DOCUMENTS

| | | |
|---|---|---|
| 810632 | 8/1993 | Belgium . |
| 0 506 995 | 10/1992 | European Pat. Off. . |
| 2405496 | 8/1974 | Germany . |
| 47-26321 | 7/1972 | Japan . |
| 50-18317 | 2/1975 | Japan . |
| 56-29643 | 3/1981 | Japan . |
| 57-54239 | 3/1982 | Japan . |
| 59-133341 | 7/1984 | Japan . |
| 60-82632 | 5/1985 | Japan . |
| 60-82634 | 5/1985 | Japan . |
| 63-100144 | 5/1988 | Japan . |
| 1-73035 | 3/1989 | Japan . |
| 2-145736 | 6/1990 | Japan . |
| 3-170647 | 7/1991 | Japan . |
| 4-2416 | 1/1992 | Japan . |
| 53-97927 | 9/1993 | Japan . |
| 3-291342 | 10/1993 | Japan . |

OTHER PUBLICATIONS

500947, Nov. 3, 1976, SU patent publication.

Partial Translation of Japanese Patent Public Disclosure No. 54–135618, dated Oct. 22, 1979 (1 page).

*Primary Examiner*—Sikyin Ip

*Attorney, Agent, or Firm*—Flynn, Thiel, Boutell & Tanis, P.C.

[57] ABSTRACT

A drinking water installation is made up of a source of drinking water and equipment for delivering the drinking water. In the equipment for delivering drinking water, a copper-zinc alloy which does not contain lead or bismuth is used. This alloy has a copper to zinc ratio of from 1.3 to 2.0 and contains at least one additive for improving the properties of the alloy. This alloy possesses superior machinability properties and yet does not pose the potential toxic hazard that lead- or bismuth-containing alloys do.

2 Claims, 3 Drawing Sheets

COPPER-ZINC-ALLOY FOR USE IN DRINKING-WATER INSTALLATIONS

This application is a division of U.S. Ser. No. 08/547,453, filed Oct. 24, 1995, now abandoned.

FIELD OF THE INVENTION

The invention relates to a copper-zinc-alloy for use in drinking-water installations, in particular for the manufacture of fittings, connecting pieces and other articles that are to be in brief or continuous contact with drinking water.

BACKGROUND OF THE INVENTION

To manufacture drinking-water installations, preferably copper-zinc-alloys with a copper content of between 57 and 63% and a zinc content of between 36 and 40% are utilized (the e information relating to weight). For the subsequent and finishing treatment of these materials, their cutting properties are of a particular importance. By the alloying of the element lead in amounts of up to typically 3.5%, an excellent cutting capability is achieved, since lead has practically no mixing ability with the matrix elements copper and zinc and functions to create a homogenous distribution and a globular separation ifarticles a chip breakers Materials such as {CuZn36Pb3, CuZn3gPb2 and cuZn3gPb3} are examples of such alloys and are also identified as machining brasses.

Aside from the technical treatment advantages, however, the toxic effect of the lead element on the human organism has lately been clearly proven in many medical tests. science has been able to prove that lead in significant amounts is not only absorbed through breathing but also through food and especially through drinking water. Infants and small children are particularly affected by this. This situation has been met among others with the prohibition of Pb-containing soldering materials in drinking-water installations.

Whereas the drinking-water regulation of the Federal Republic of Germany dictates a limiting value of 40 μg Pb per liter of drinking water, the world-health organization (WHO) suggests in its revised draft of the regulations for drinking-water quality a maximum value of 10 μg pb per liter. The State of California in the United States of America is debating an introduction of laws which set a maximum value of 0.25 μg Pb per liter of drinking water.

As a result of information from literature and some tests with synthetic testing waters, the set value of 10 μg Pb per liter of drinking water is not safely maintained by the cutting brass used for fittings having lead (Pb) contents of between 1.5 and 3%. Copper-zinc-alloys with clearly less than 1% Pb do meet, on the one hand, the requirement formulated by WHO. However, they no longer have, on the other hand, because of the low Pb-addition, the cutting properties needed for machining.

In order to reduce the lead in Pb-containing cutting brass, the literature often describes a method for the treatment of affected articles in a sodium acetate solution. The method is based on the thought of a selective extraction of lead and the related reduction of lead in the surface-near areas of the article. Tests by Paige and Covino (corrosion, 48, 12, Pages 1040 to 1046) support, however, that with the pretreatment in a sodium-acetate solution, none of the Pb-containing test alloys achieved a noticeable reduction of lead emission compared with non-treated materials. It is possible in the most advantageous scenario that lubricant films caused by cutting can be removed at the surface, however, a continuous protection against a further lead release from the material does not exist.

EP-OS 0 506 995 describes a cuttable copper-zinc-alloy with additives of the lanthanide group, in particular lanthanum, cerium, praseodymium, neodymium or mixed metal. As an important part of the material, lead is added by alloying in amounts of up to 3.5% so that the demand for a clear reduction of lead release cannot be met.

In 1934 U.S. Pat. No. 1,959,509 disclosed the influence of the addition by alloying of bismuth in amounts of between 1 and 6%, to favorably influence the cutting property of copper alloys. JP-OS 54-135618 describes a copper-zinc-alloy with 58 to 65% Cu, the cutting property of which is based on the addition of 0.5 to 1.5% Bi. Lead-free copper-zinc-alloys with improved cutting properties and amounts of bismuth of between 0.5 and 1.5% or rather 1.8 and 5% are described in U.S. Pat. Nos. 5,167,726 and 5,137,685.

The substitution of bismuth for lead meets, on the one hand, the demand by drinking-water installations for low-Pb or rather Pb-free materials. However, on the other hand, it brings about risks in manufacturing techniques.

Thus, it is already sufficiently known that small contaminating amounts of bismuth significantly worsen the hot-forming property of copper and copper materials, in particular, technically common brass, bronze and nickel-silver alloys. This phenomena is caused by the wetting reactions of the liquidy bismuth at the grain boundaries of the material and the temperature embrittlement resulting therefrom.

Of particular importance is the fact that bismuth and lead, because of their position in the classification of elements, have a high degree of affinity. Both elements are often naturally related to one another. Whereas the toxic effect of lead has been sufficiently researched, clear information regarding the effect of bismuth on the human organism presently does not yet exist.

SUMMARY OF THE INVENTION

Therefore, the basic purpose of the invention is to provide a copper alloy for the above-identified use, which has a cutting behavior favorable for further machining and contains neither lead nor bismuth.

The purpose is attained according to the invention by using a copper-zinc-alloy in which the ratio between the copper content and the zinc content lies between 1.3 and 2.0 and contains the following additives:

a) thermally stable dispersoids, which exist in the structure through the addition of at least one compound from the group $Cr_2Ta$, $Dy_2O_3$, $Er_2O_3MoB$, $Mo_2C$, NbC, $Nd_2O_3$, $Sm_2O_3$, $WS_2$, $Yb_2O_3$, ZrC in a total content of 0.1 to 5.0%, and/or b) intermetallic phases with the matrix elements copper and/or zinc, the formation of which is caused by the addition of at least one element from the group of yttrium and zirconium in a total content of 0.1 to 5.0%, and/or c) intermetallic phases without participation of the matrix elements copper and zinc, the formation of which is caused by the addition of at least one element from the group of cerium lanthanum, nickel in the total content of 0.1 to 5.0% and at least one further element from the group of aluminum, niobium, antimony and tin, in a total content of 0.1 to 5.0%, and/or d) thermally activated separations, which exist in the structure through the addition of at least one element from the group of silver, cobalt, magnesium and titanium in a total content of 1.0 to 5.0%.

(The % information refers to weight.)

DETAILED DESCRIPTION

Figure 1:
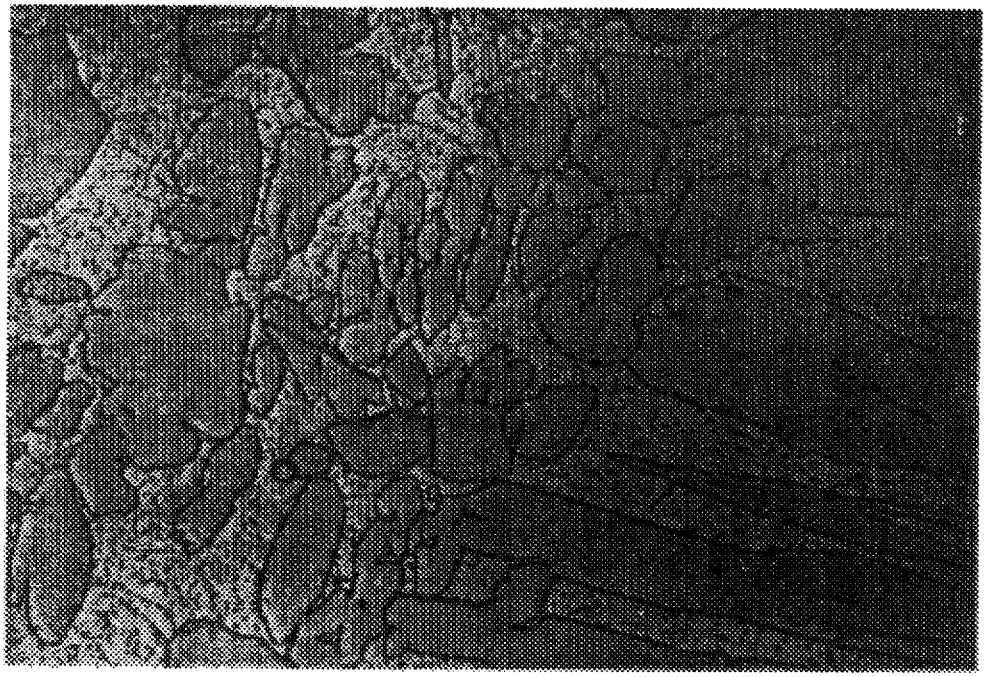
FIG. 1 illustrates the cast structure magnified 500 times.

Dispersoids act similarly to lead as chip breakers when they exist as discrete particles. They are introduced into the melt in the form of powders having a corresponding particle size. The dispersoid must thereby, on the one hand, be thermally stable so that it will not decompose or melt and must, on the other hand, be thermodynamically stable with respect to reactions with the matrix elements copper and zinc. In order to achieve an as low as possible segregation distribution in the melt and the solidified cast structure, the dispersoid particles must be easily wettable and their specific weight should correspond approximately with that of the melt.

The compounds listed in Table 1 meet these criteria. The melting point of the dispersoid serves as a measure of judging its thermal stability.

TABLE 1

Compounds which are suitable in copper-zinc-alloys for adjusting thermally stable dispersoids with a chip-breaking effect.

| Compound | Melting Temperature in °C. | Density in g/cm$^3$ |
|---|---|---|
| $Cr_2Ta$ | 2020 | 11.1 |
| $Dy_2O_3$ | 2340 | 7.8 |
| $Er_2O_3$ | 2400 | 8.6 |
| MoB | 2600 | 8.6 |
| $Mo_2C$ | 2687 | 8.9 |
| NbC | 3500 | 7.8 |
| $Nd_2O_3$ | 1900 | 7.2 |
| $Sm_2O_3$ | <1500 | 8.3 |
| $WS_2$ | 1250 | 7.5 |
| $WSi_2$ | 2165 | 9.4 |
| $Yb_2O_3$ | 2227 | 9.1 |
| ZrC | 3540 | 6.7 |

The total content of the dispersoids is preferably 0.5 to 3%.

The cutting property of a copper-zinc-alloy can be improved by the addition of elements which cannot be mixed with the matrix elements in a solid state. However, with the participation of copper and/or zinc, then form intermetallic phases. They should not have high melting temperatures in order to avoid primary crystallization from the melt.

The element yttrium forms intermetallic compounds with copper and zinc having melting points below 980° C. Zirconium reacts with copper at 1116° C. to form $Cu_4Zr$ and at approximately 1050° C. to form $Cu_6Zr$. The intermetallic phases exist then, similarly to the dispersion particles, as discrete particles at the grain boundaries.

The total content of the added elements yttrium, zirconium is 0.2 to 2.5%.

Instead of intermetallic compounds of third elements with copper and/or zinc, it is also possible to adjust intermetallic phases without the participation of the matrix elements. The phase-forming elements are thereby initially dissolved in the melt. The actual phases form out of the added elements among one another, based on their higher formation enthalpies in comparison to corresponding phases with copper and/or zinc. As a consequence of the higher formation enthalpies, these phases have an extraordinary thermodynamic stability, which is generally also expressed by their high melting temperatures. As a selection criteria for suitable third-element pairings, which is the complete mixability of both components in the copper-zinc melt, a significantly higher formation enthalpy of the compound to be adjusted than that of compounds of copper and/or zinc with the added components and a small density difference between the melt and intermetallic phase must therefore be taken into consideration.

The total content of the elements forming these intermetallic phases is preferably 0.5 to 3%.

The intermetallic phases listed in Table 2 essentially meet the mentioned criteria. The formation enthalpies of some compounds are not known, their suitability, however, can be judged based on their melting temperatures. The standard formation enthalpy of β-CuZn is, as a comparison approximately −18 kJ/mol.

TABLE 2

Intermetallic compounds with chip-breaking effect in copper-zinc-alloys.

| Compound | Melting Temp. in °C. | Density in g/cm$^3$ | Standard Formation enthalpy in kJ/mol |
|---|---|---|---|
| $CeAl_2$ | 1480 | 5.0 | −163.2 |
| $LaAl_2$ | 1405 | 4.7 | −150.6 |
| $La_3Sb$ | ca. 1690 | | |
| LaSb | ca. 1540 | 6.3 | |
| $La_2Sn$ | 1420 | ca. 7 | |
| $Ni_3Al$ | 1395 | 7.3 | −153.1 |
| NiAl | 1638 | 5.9 | −118.4 |
| $Ni_3Nb$ | ca. 1400 | 8.8 | |

Elements, which in the solid state completely or partially dissolve in copper and/or zinc, and the solubility of which clearly decreases with a decreasing temperature, result, with a suitable heat treatment, in separations from the over saturated mixed crystal. They can be discontinuous separations at the grain boundaries and/or continuous separations in the matrix volumes. To improve the cutting properties, the grain-boundary separations have a higher effectiveness. Separations, which are created by homogeneous nucleus formation, can, however, be shifted to the grain boundaries through a suitable hot and cold formation.

A three-phase balance between α-CuZn, β-CuZn and an Ag-rich mixed crystal exists below 665° C. in the system of copper-zinc-silver, which separates with a decreasing temperature from the α- and β-structure. The addition of cobalt leads to a discontinuous separation of a Co-rich mixed crystal, which at 672° C. has the approximate composition $CoCu_{11}Zn_{28}$. Small additions of magnesium lead to the separation of the Laves-phase $Mg(Cu, Zn)_2$. The ternary phase Cu2TiZn is formed at 950° C. in the system of copper-zinc-titanium. The solubility for titanium in the β-phase is at room temperature approximately 2%.

The total content of the separation-forming elements aluminum, cobalt, magnesium, titanium is preferably 1 to 3% and the silver content 3 to 5%.

According to a particular embodiment of the invention, the total content of all additives is 10% at a maximum.

The ratio between the copper content and zinc content lies in particular between 1.4 and 1.7.

The invention will now be discussed in greater detail in connection with the following exemplary embodiments:

EXAMPLE 1

Elementary copper and nickel were melted together with a Cu-Al-key alloy at 1450° C. After the melt cooled off to 1100° C. elementary zinc was added by alloying. The composition of the melt was {CuZn37(Ni3Al))2}. The casting of the melt took place in a standard iron mold. The cast structure was subsequently hot-formed with a forming degree of 55%, followed by a 15% cold-forming.

FIG. 1 shows the cast structure of the material 500 times enlarged. The intermetailic $Ni_3Al$-phase exists in a finely distributed form preferably in the β-mixed crystals.

Table 3 gives the mechanical characteristic values determined at the cold-formed state (Brinell hardness HB, tensile strength Rm, yield point Rp 0.2, expansion A10, cutting index Zi).

Figure 2:
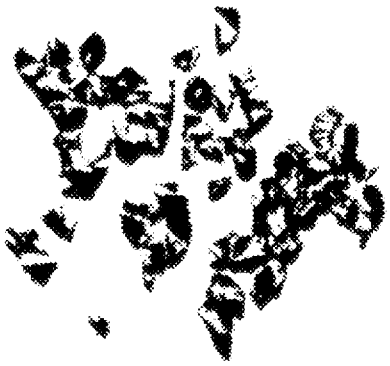
FIG. 2 illustrates a macro-image of the turning chips.

The material has a cutting index of approximately 80 to 90. FIG. 2 shows a macro-image of the resulting turning chips in a scale of 1:1 (cutting speed $V_c$=100 m/min, advance f=0.1 mm/revolution, chip depth a=2.5 mm, chip angle γ=0°, setting angle α=8°).

Figure 3:
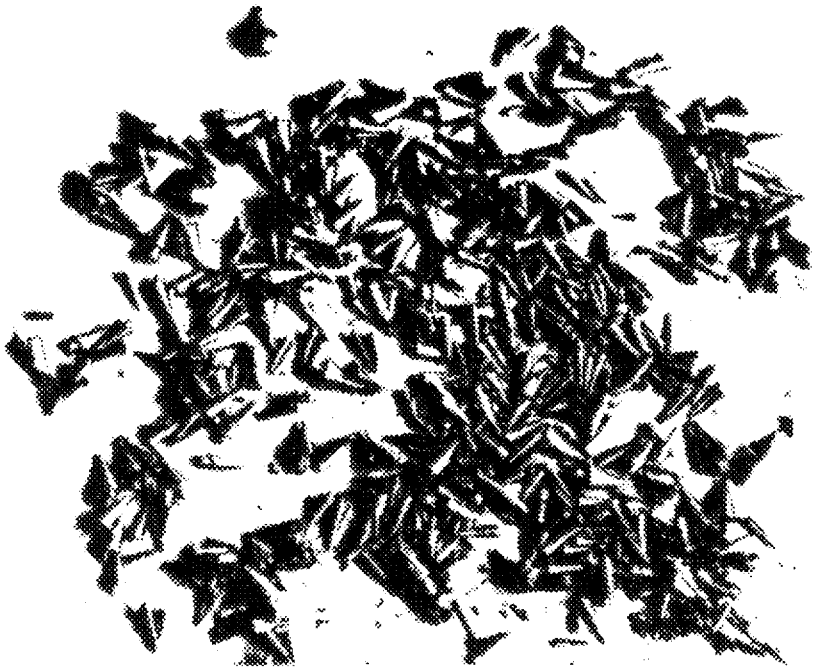
FIG. 3 illustrates a chip image of {CuZn3gPb3} with a cutting index of 100.
Figure 4:
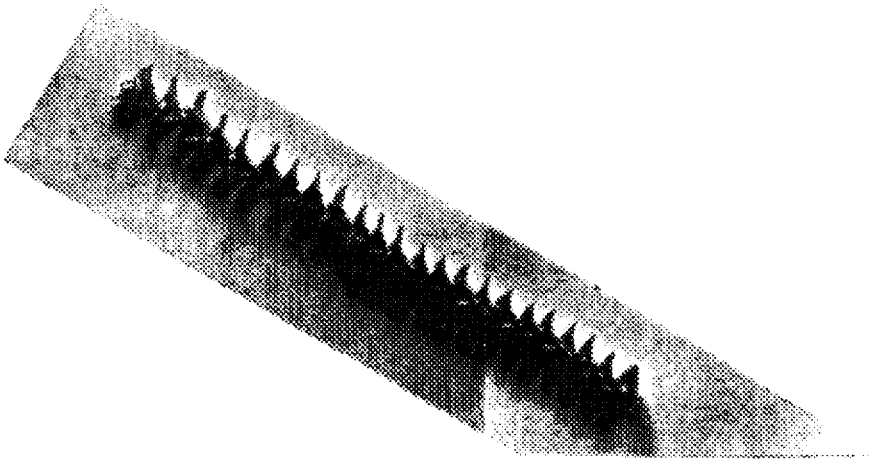
FIG. 4 illustrates a chip image of {CuZn37} with a cutting index<40.

As a comparison, the chip image of the material $CuZn_{39}Pb_3$ is shown with a cutting index of 100 in FIG. 3 and of the material $CuZn_{37}$ with a cutting index of <40 in FIG. 4, in each case under the same conditions.

EXAMPLE 2

Figure 5:
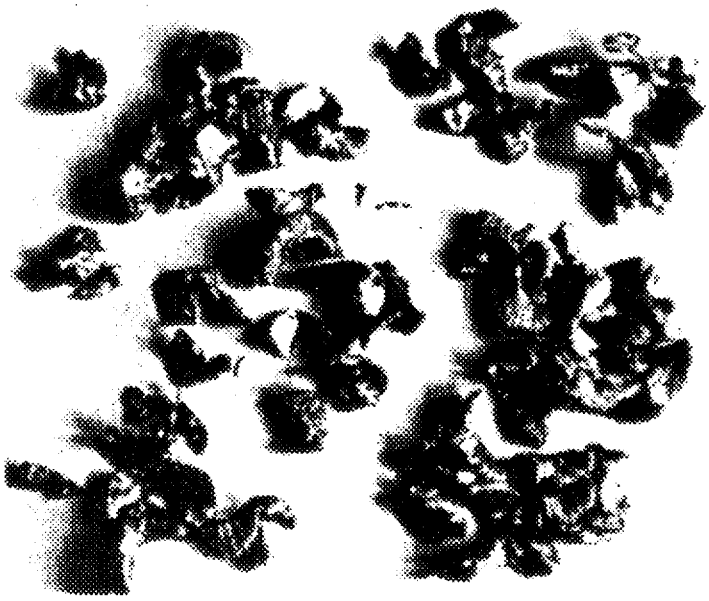
FIG. 5 illustrates a chip image of the material of Example 2 with a cutting index of approximately 70 to 80.

2% by weight of $Mo_2C$-powder with a grain size <45 μm was stirred into a cu-Zn-alloy of the composition $CuZn_{39}$. The further processing was done according to the exemplary Embodiment 1. The mechanical characteristic values of the cold-formed material are listed in Table 3. FIG. 5 shows a typical chip sample (compare the above conditions). The cutting index was approximately 70 to 80.

EXAMPLE 3

Figure 6:
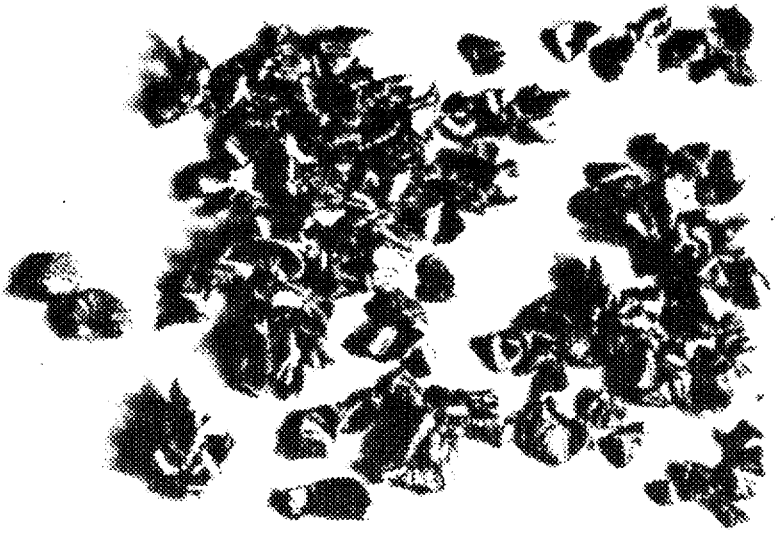
FIG. 6 illustrates a chip image of the material of Example 3 with a cutting index of approximately 70 to 80.

Elementary copper was melted together with a Cu-Co-key-alloy. After adding elementary zinc, the alloy with the composition {CuZn3gCo3} was cast according to the exemplary Embodiment 1 and further processed. The mechanical characteristic values of the cold-formed material are also assembled in Table 3. The cutting index was approximately 70 to 80. FIG. 6 shows a corresponding chip sample (compare the above conditions).

TABLE 3

Mechanical characteristic data of the materials mentioned in the exemplary embodiments in comparison to commercial materials. Condition: 15% cold-formed.

| Example | Material | HB 2.5/62.5 | RM in N/mm² | RpO.2 in N/mm² | A10 in % | Zi |
|---|---|---|---|---|---|---|
| 1 | CuZn39($Ni_3Al$)2 | 138 | 462 | 353 | 29.3 | 80–90 |
| 2 | CuZn39($Mo_2C$)2 | 131 | 450 | 348 | 21.8 | 70–80 |
| 3 | CuZn39Co3 | 128 | 465 | 371 | 27.8 | 70–80 |
| | CuZn39Pb3 | 128 | 485 | 345 | 23.2 | 100 |
| | CuZn37 | 104 | 372 | 265 | 42 | <40 |

We claim:

1. A drinking water installation comprising a source of drinking water and means for delivering said drinking water, the improvement comprising said means for delivering said drinking water comprising a metal member which contacts with said drinking water and is formed from a copper-zinc alloy containing at least one additive, wherein the copper and zinc are present in the alloy in a ratio of from 1.3 to 2.0 and said at least one additive is selected from the group consisting of (A), both (A) and (B), both (A) and (C), and both (A) and (D):

(A) the group consisting of $Cr_2Ta$, $DyO_3$, $Er_2O_3$, MoB, $Mo_2C$, NbC, $Nd_2O_3$, $Sm_2O_3$, $WS_2$, $Yb_2O_3$ and ZrC in a total amount of from 0.1 to 5.0%;

(B) the group consisting of Y and Zr in a total amount of from 0.1 to 5.0%;

(C) the group consisting of Ce, La and Ni in a total amount of from 0.1 to 5.0% and combined with at least one member selected from the group consisting of Al, Nb, Sb and Sn in a total amount of from 0.1 to 5.0%; and (D) the group consisting of Ag, Co, Mg and Ti in a total amount of from 1.0 to 5.0%.

2. A drinking water installation comprising a source of drinking water and means for delivering said drinking water, the improvement comprising said means for delivering said drinking water comprising a metal member which contacts with said drinking water and is formed from an alloy consisting of copper, zinc and at least one additive, wherein the copper and zinc are present in the alloy in a ratio of from 1.3 to 2.0 and said at least one additive is selected from the group consisting of (A), both (A) and (B), both (A) and (C), and both (A) and (D):

(A) the group consisting of $Cr_2Ta$, $DyO_3$, $Er_2O_3$, MoB, $Mo_2C$, NbC, $Nd_2O_3$, $Sm_2O_3$, $Ws_2$, $WSi_2$, $Yb_2O_3$ and ZrC in a total amount of from 0.1 to 5.0%;

(B) the group consisting of Y and Zr in a total amount of from 0.1 to 5.0%;

(C) the group consisting of Ce, La and Ni in a total amount of from 0.1 to 5.0% and combined with at least one member selected from the group consisting of Al, Nb, Sb and Sn in a total amount of from 0.1 to 5.0%; and (D) the group consisting of Ag, Co, Mg and Ti in a total amount of from 1.0 to 5.0%.

* * * * *

UNITED STATES PATENT AND TRADEMARK OFFICE

CERTIFICATE OF CORRECTION

PATENT NO. : 5 766 377

DATED : June 16, 1998

INVENTOR(S) : Gert MUELLER et al

It is certified that error appears in the above-identified patent and that said Letters Patent is hereby corrected as shown below:

Column 6, line 17; change "$WS_2$, $Yb_2O_3$" to ---$WS_2$, $WSi_2$, $Yb_2O_3$---.

Signed and Sealed this

Seventeenth Day of November, 1998

*Attest:*

Bruce Lehman

BRUCE LEHMAN

*Attesting Officer*

*Commissioner of Patents and Trademarks*